United States Patent [19]

Bouru

[11] Patent Number: 4,818,182

[45] Date of Patent: Apr. 4, 1989

[54] SYSTEM FOR LOCKING TURBINE BLADES ON A TURBINE WHEEL

[75] Inventor: Michel A. Bouru, Moissy Cramayel, France

[73] Assignee: Societe Nationale d'Etude et de Construction de Moteurs d-Aviation (SNECMA), Paris, France

[21] Appl. No.: 202,827

[22] Filed: Jun. 6, 1988

[30] Foreign Application Priority Data

Jun. 10, 1987 [FR] France ..... 87 08044

[51] Int. Cl.[4] ..... F01D 5/32

[52] U.S. Cl. ..... 416/215; 416/221

[58] Field of Search ..... 416/215–217, 416/221

[56] References Cited

U.S. PATENT DOCUMENTS

| | | | |
|---|---|---|---|
| 3,383,094 | 5/1968 | Diggs | 416/215 |
| 3,597,112 | 8/1971 | Garten | 416/215 |
| 3,902,824 | 9/1975 | Sauer | 416/215 |
| 4,462,756 | 7/1984 | Muggleworth et al. | 416/215 |
| 4,465,432 | 8/1984 | Mandet et al. | 416/215 |
| 4,684,325 | 8/1987 | Arnold | 416/215 |
| 4,743,166 | 5/1988 | Elston et al. | 416/215 |

FOREIGN PATENT DOCUMENTS

| | | | |
|---|---|---|---|
| 812337 | 8/1951 | Fed. Rep. of Germany | 416/215 |
| 2423690 | 11/1975 | Fed. Rep. of Germany . | |
| 1541373 | 10/1968 | France . | |
| 2359966 | 2/1978 | France . | |
| 2519073 | 7/1983 | France . | |
| 849124 | 9/1960 | United Kingdom | 416/215 |

*Primary Examiner*—Everette A. Powell, Jr.
*Attorney, Agent, or Firm*—Bacon & Thomas

[57] ABSTRACT

A system for locking turbine blades onto a turbine wheel is disclosed in which a locking member is disposed totally radially inwardly of the turbine blade platforms, thereby enabling the platforms to define a continuous annular wall. Turbine blades are each inserted through a "window" and circumferentially displaced in a turbine wheel groove until space remains on the circumference of the turbine wheel for three turbine blades. The locking device cooperates with the last three turbine blades to lock the blades in position on the turbine wheel. The locking device is resiliently deformable and has a central portion having a cross-sectional shape generally similar to that of the circumferential groove. Locking flanges extend in an axial direction from the center section and engage locking notches defined by circumferentially extending ribs formed on the turbine wheel on either side of the circumferential groove. Once the locking device and the final three sealing turbine blades have been installed, all of the blades and the locking device are circumferentially displaced such that the locking flanges engage the locking notches to prevent any undesired circumferential movement. The locking notches are oriented with respect to the "window" such that, in the locked position, no single turbine blade is in alignment with the "window".

8 Claims, 4 Drawing Sheets

SYSTEM FOR LOCKING TURBINE BLADES ON A TURBINE WHEEL

BACKGROUND OF THE INVENTION

The present invention relates to a system for locking turbine blades on a turbine rotor wheel, as well as methods for assembling and disassembling the turbine blades and the turbine rotor wheel.

Known techniques for attaching blades to a turbine wheel include forming a circumferentially extending groove around the periphery of the turbine wheel, the groove having a generally dovetail shaped cross-section, and forming each of the turbine blades with an enlarged foot portion, having a cross-sectional shape similar to that of the circumferential groove. The interengagement of the enlarged foot portion on the blades with the groove formed in the turbine wheel serves to radially retain the turbine blades on the turbine wheel.

This system has proven very effective in accomplishing radial retention of the blades, but has created problems regarding the assembly and disassembly of the structures. As a rule, the axial dimension (the dimension measured in a direction generally parallel to the axis of rotation of the turbine wheel) of the enlarged foot portions formed on the turbine blades exceed that of the opening of the circumferential groove. Therefore, in order to insert the foot portions of the blades into the circumferential groove, at least one "window" must be provided on the rim of the turbine wheel. The axial dimension of this "window" or enlarged opening is sufficient to allow the radial insertion of the enlarged foot portions into the groove. Once inserted, the turbine blades may be circumferentially displaced away from the window such that the foot portions are radially retained in the circumferential groove.

In order to avoid the formation of such a "window" it is known to form the enlarged foot portion with a narrow circumferential dimension such that they may be inserted into the groove opening by turning them sideways. Once the enlarged foot portion passes into the circumferential groove, the blades are then rotated 90° to engage the enlarged foot portions and the circumferential groove.

As is well known in the art, the turbine blades may be provided with platforms which, when the blades are assembled on the turbine wheel, delineate one side of the gas passage over the turbine wheel. The individual platforms form a substantially continuous ring when the blades are installed on the turbine wheel to define the wall of the gas passage. It is desirable to maintain this wall as a continuous annular formation to avoid any disturbances in the passage of the gases over the turbine wheel, such disturbances serving to reduce the efficiency of the turbine assembly. The platforms of the turbine blades which are installed into the turbine wheel by rotating 90° must have at least opposite corners thereof rounded or otherwise removed to facilitate the rotation of the turbine blade once it is placed into the turbine wheel groove. Quite obviously, this will prevent the formation of the continuous annular structure desired to maximize turbine efficiency.

By using an enlarged opening or "window", the rounding or removal of corners of the turbine blade platforms may be eliminated. However, quite obviously, some means must be utilized to lock the turbine blades in position on the turbine wheel such that they cannot be inadvertantly removed through the "window". The most rudimentary form of such locking mechanism involve bolts or nuts extending through the turbine blade platforms. These have proven totally unsatisfactory, since, not only do they create gas flow disturbances, but the bolts or nuts may loosen during turbine operation and cause catastrophic damage to the turbine.

Other known system utilize internal locking devices which are disposed below the annular ring formed by the turbine blade platforms and are, thus, out of the gas flow stream. However, means must be provided for attaching and removing such locking devices and, typically, these means necessitate the formation of an opening or orifice through one or more of the platforms. These openings also cause disturbances in the gas flow, thereby reducing the efficiency of the turbine.

French Pat. No. 1,541,373 describes a locking device that is located between two blade roots and wherein the blade platforms form apertures to allow insertion and removal of the locking device. Not only does the platform aperture form a disturbance in the boundary layer flow and degrade the compressor operation, such disturbances may produce vibrations that may unlatch the locking means and cause the blades to slip in the mounting groove.

A similar, but more complex, locking apparatus is disclosed in U.S. Pat. No. 4,462,756. This locking means still requires apertures to be formed in the blade platform, resulting in the aforementioned deficiencies.

SUMMARY OF THE INVENTION

The present invention provides a system for locking turbine blades onto a turbine wheel that does not require an aperture to be formed in the turbine blade platforms, nor does it require any of the locking mechanism to extend into the gas flow stream to cause disturbances. The locking device for the system is disposed totally radially inwardly of the turbine blade platforms, thereby enabling the platforms to define a continuous annular wall.

The system according to the invention utilizes a 'window' formed in the turbine wheel to provide access into the dovetail circumferential groove for the enlarged foot portions of the turbine blades. The turbine blades are each inserted through the "window" and circumferentially displaced until space remains on the circumference of the turbine wheel for three turbine blades. The locking device cooperates with the last three turbine blade to lock all of the blades in position on the turbine wheel.

The locking device is resiliently deformable and has a central portion having a cross-sectional shape generally similar to that of the circumferential groove. Locking flanges extend in an axial direction from the center section and are adapted to engage locking notches defined by circumferentially extending ribs formed on the turbine wheel on either side of the circumferential groove. The circumferential length of the locking device is such that is extends beyond a circumferential distance occupied by one turbine blade platform and extends into clearances formed on the platforms of adjacent turbine blades.

Once the locking device and the final three sealing turbine blades have been installed, all of the blades and the locking device are circumferentially displaced such that the locking flanges engage the locking notches to prevent any undesired circumferential movement. The locking notches are oriented with respect to the 'window' such that, in the locked position, no single turbine blade foot portion is in alignment with the "window".

The locking system according to the invention also avoids the possibility of any gas re-circulation around the roots of the turbine blades and avoids any consequent pressure loss.

DETAILED DESCRIPTION OF THE PREFERRED EMBODIMENTS

Figure 1:
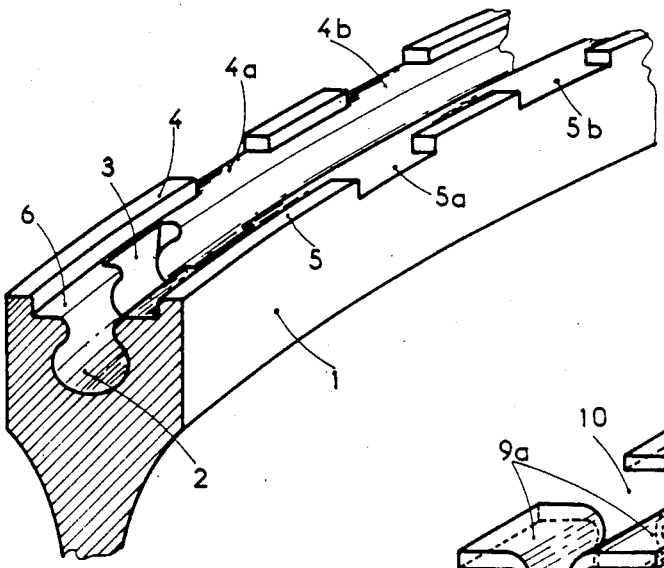
FIG. 1 is a partial, perspective view of a turbine wheel rim showing the circumferential groove, the circumferential ribs and the locking notches according to the invention.
Figure 3:
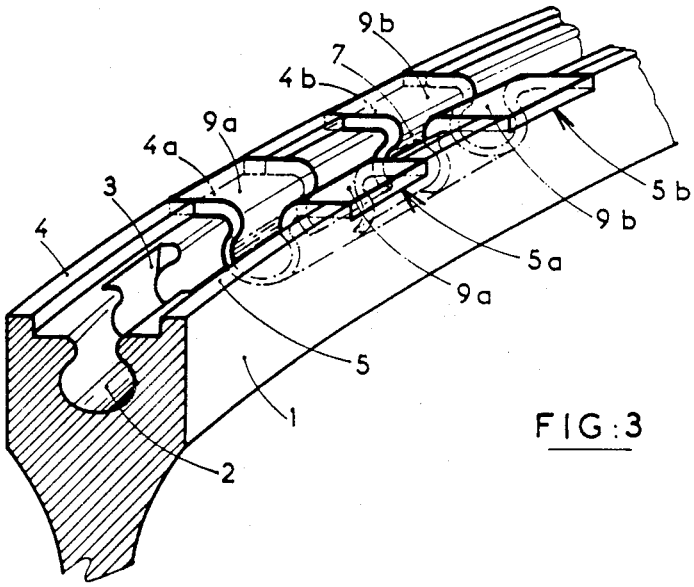
FIG. 3 is a partial, perspective view, similar to FIG. 1, showing the turbine wheel view and the locking device of FIG. 2 assemblied therewith.

A portion of a rotor wheel, such as that utilized in a high pressure compressor of a gas turbine engine, is illustrated in FIGS. 1 and 3 and comprises a wheel rim 1 having a circumferential groove 2 formed in its periphery. Circumferential groove 2 has an enlarged radially inward portion and a narrow opening portion to form part of a dovetail joint with a enlarged foot portion of the turbie blades. A "window" or enlarged opening 3 communicates with groove 2 in a generally radial direction and allows the insertion of the enlarged foot portions of the turbine blades to be inserted radially into the circumferential groove 2. After radial insertion, each of the turbine blades is circumferentially displaced away from the "window" 3 such that they are radially retained in the circumferential groove 2 by their enlarged foot portions.

The rotor disk 1 has circumferentially extending ribs 4 and 5 located on its periphery such that they extend radially outwardly therefrom and are located on either side of the circumferential groove 2. The radially outer surfaces of ribs 4 and 5 bear against a radially inward surface of the turbine blade platforms to support the blades once they are installed on the turbine wheel. A circumferentially extending flat portion 6 extends between the ribs 4 and 5 and the circumferential groove 2. Each rib 4 and 5 defines a pair of locking notches 4*a*, 4*b*, 5*a*, and 5*b*, respectively, in which the radially inner portion is coplanar with the flat 6. Notch 4a may be circumferentially aligned with notch 5*a*, while notch 4b is circumferentially aligned with locking notch 5*b*. As will be explained in more detail hereinafter, locking notches 4*a*, 4*b*, 5*a* and 5*b* engage locking flanges formed on the locking member 7 to circumferentially retain the locking member in place on the turbine wheel rim 1.

Figure 2:
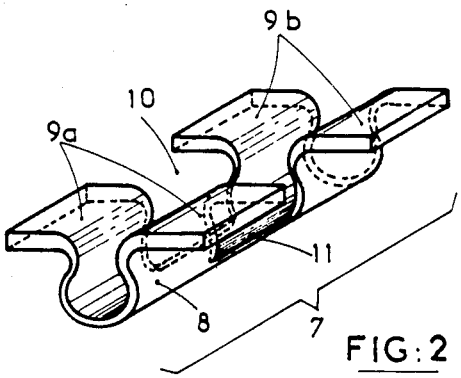
FIG. 2 is a perspective view of the locking member according to the invention.

The locking member 7 according to the invention is formed from a resiliently deformable metallic material and comprises a center section 8 having a cross-sectional shape similar to that of circumferential groove 2 as illustrated in FIG. 2. Extending in a generally axial direction (i.e., a direction generally parallel to the rotational axis of the turbine wheel) are locking flanges 9*a* and 9*b* which are generally coplanar. Between locking flanges 9*a* and 9*b*, the locking member 7 defines a central clearance 10 having a width approximately equal to that of a root portion of a turbine blade. The width of locking flanges 9*a* and 9*b* is slightly smaller than that of notches 4*a*, 4*b*, 5*a* and 5*b* such that the locking flanges may engage the locking notches. The form of the locking member 7 illustrated in FIG. 2 has generally the shape of a pair of inverted omegas interconnected by a strap 11.

Figure 4:
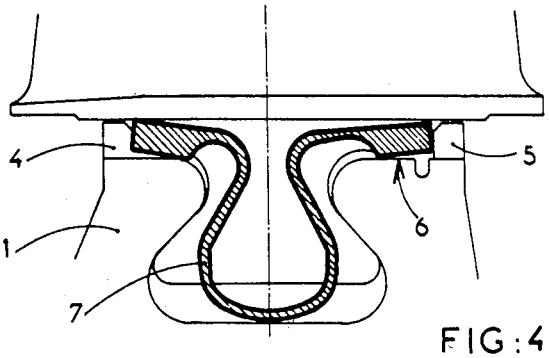
FIG. 4 is a partial, cross-sectional view showing the turbine wheel rim and the locking member before the locking flanges have engaged the locking notches.

Since locking member 7 is formed of a resiliently deformable material, locking flanges 9*a* and 9*b*, as well as center section 8 may be axially compressed such that the central section 8 may be radially inserted through the relatively narrow opening of the circumferential groove 2. The axial distance between the opposite edges of locking flanges 9*a* and 9*b* is, when the center section is compressed so as to be slidably received in the circumferential groove 2, somewhat smaller than the axial distance between circumferential ribs 4 and 5. This enables the locking member 7 to be disposed in the groove 2 such that the locking flanges are located between the circumferential ribs, as illustrated in FIG. 4. As is also illustrated in this figure, the radially outward surfaces of the compressed locking flanges 9*a* and 9*b* do not extend substantially radially outwardly of the plane of the outermost surfaces of the circumferential ribs 4 and 5.

Figure 6A:
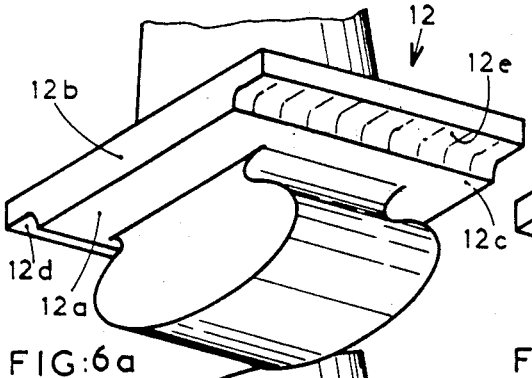
FIGS. 6*a*–6*d* are partial perspective views showing turbine blade platform configurations utilized with the present invention.
Figure 6C:
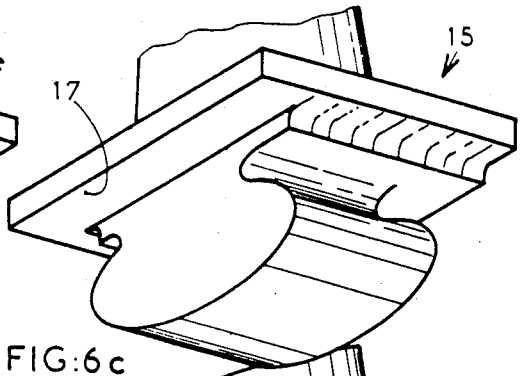
Figure 6B:
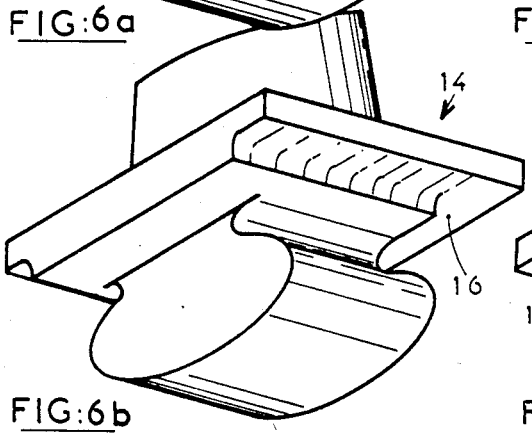

Since the locking member 7 is disposed completely beneath the platforms of the turbine blades, in some cases it may be necessary to modify the platforms and foot portions of the blades to accommodate the locking member. Turbine blade platforms, as is well known in the art, may have a shape in which the side edges are not orthogonal to the plane of the turbine wheel (known as "diamond" platforms), or the platforms may assume a shape in which the side edges do extend orthogonal to the plane of the turbine wheel. "Diamond" blade platforms, such as platform 12 illustrated in FIG. 6 have sides 12*b* and 12*c*, as well as radially inward surface 12*a*. Surface 12*a* defines notches 12*d* and 12*e* which rest against the circumferential ribs 4 and 5 when the blade is installed on the turbine wheel. As can be seen in FIGS. 6*a*, the radially inward surface 12*a* extends across the entire circumferential width of the blade platform 12. The interengagement of the grooves 12*d* and 12*e* with the circumferential ribs 4 and 5 serves to accurately align the blades and prevent any twisting or turning motion about their radial axes.

The present invention utilizes standard turbine blade structures as previously described in conjunction with FIG. 6*a*, except for three of the turbine blades which must interact with the locking member 7. The three blades are designated as lateral sealing blades 14 and 15 illustrated in FIGS. 6*b* and 6*c*, and a central sealing blade 18, illustrated in FIG. 6d. The platforms of the lateral sealing blades 14 and 15 are identical with the platform 12 shown in FIG. 6*a*, except for reduced thickness portions 16 and 17 which define radially inwardly facing clearances on one side of the enlarged foot portion. The central sealing blade 18, illustrated in FIG. 6*d*, has reduced thickness portions 19 and 20 so as to define radially inwardly facing clearances on both sides of the enlarged foot portion. The function of these inwardly facing clearances will be evident in the following description of the assembly method.

Figure 6D:
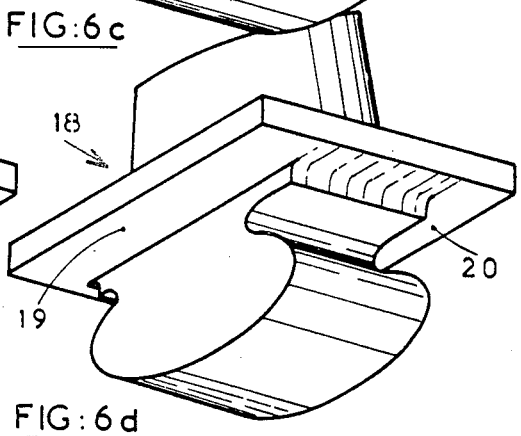

If turbine blades having platforms wherein the sides extend substantially orthogoal to the plane of the turbine wheel are utilized, each blade may be formed in the configuration shown in FIG. 6*d*, similar to that of the central sealing blade. With this platform configuration, there is no danger that the turbine blades will jam against one another during assembly, since their adjacent, mating sides extend orthogonally to the plane of the turbine wheel. Thus, the notches similar to 12*d* and 12*e*, shown in FIG. 6*a*, may be made circumferentially smaller since there is no danger of the turbine blades turing about their axes or jamming.

The methods for assembling and disassembling the turbine blades and the turbine wheel will be described in reference to FIGS. 4, 5 and 8–15. The terms "left" and "right" will refer to the sequence shown in those FIGS., however, it is to be understood these are merely for reference purposes only and such directions will vary according to the side of the turbine wheel being viewed. The assembly/disassembly methods are applicable to turbine blades having both the 'diamond' pattern platforms and the rectangular platforms.

Figure 8:
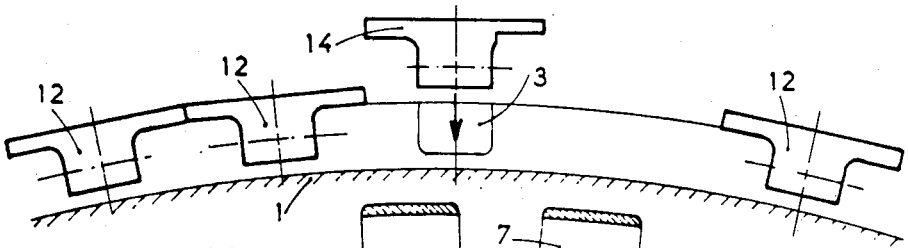
FIGS. 8–15 show partial front views of the turbine wheel illustrating the step by step method for assembling the turbine blades and the locking member onto the turbine wheel.
Figure 9:
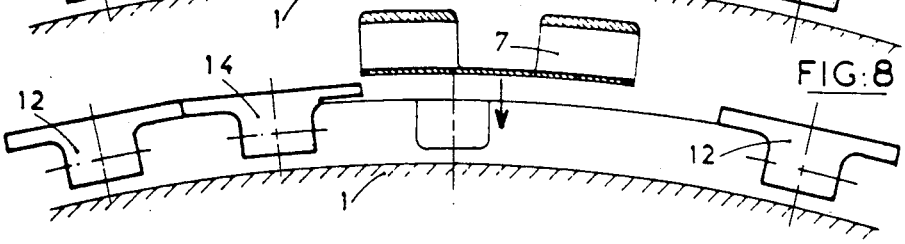
Figure 10:
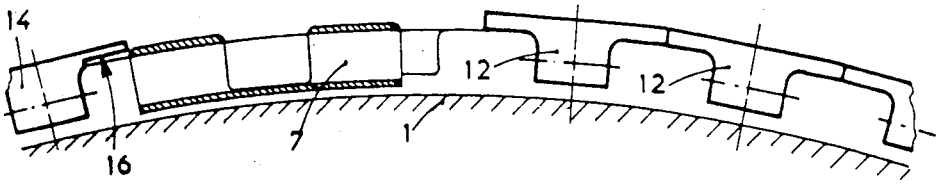

All of the turbine blades, with the exception of three, are radially inserted into the circumferential groove via the "window" 3 and are circumferentially displaced away from the "window" 3 until space remains for three turbine blades. At this point, the left lateral sealing blade 14 is inserted through the "window" 3 and circumferentially displaced to the left as illustrated in FIGS. 8 and 9. FIG. 9 shows that the clearance 16 of the left lateral sealing blade 14 faces the "window"3.

Figure 11:
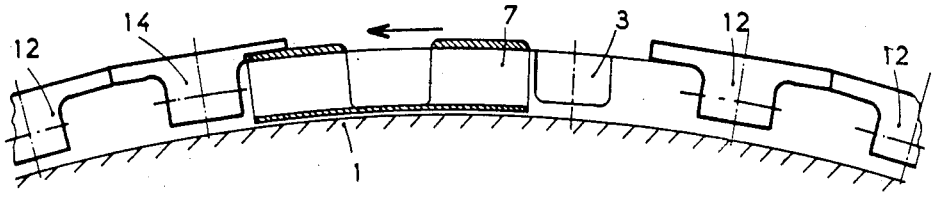

Locking member 7 is then inserted into the groove 2 by resiliently compressing the central portion and the locking flanges such that the locking flanges 9*a* and 9*b* are located between the circumferential ribs 4 and 5 (see FIG. 4). The thusly compressed locking member 7 is circumferentially displaced to the left such that a portion of the locking flanges is accommodated in the radially inwardly facing clearance 16 of turbine blade 14 as seen in FIG. 11.

Figure 12:
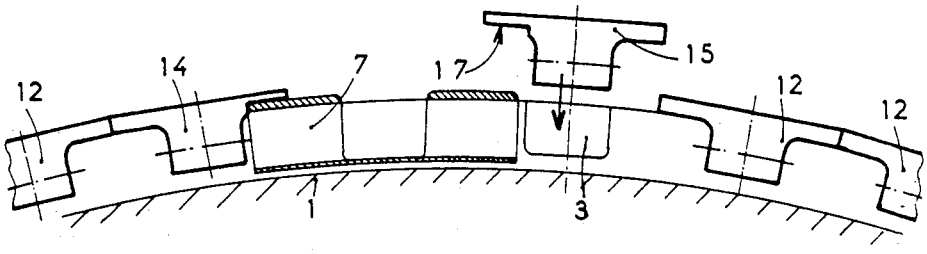
Figure 13:
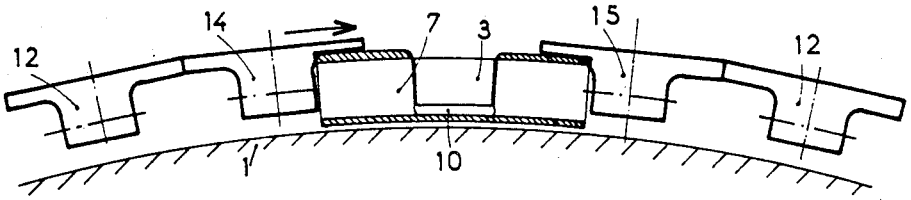
Figure 14:
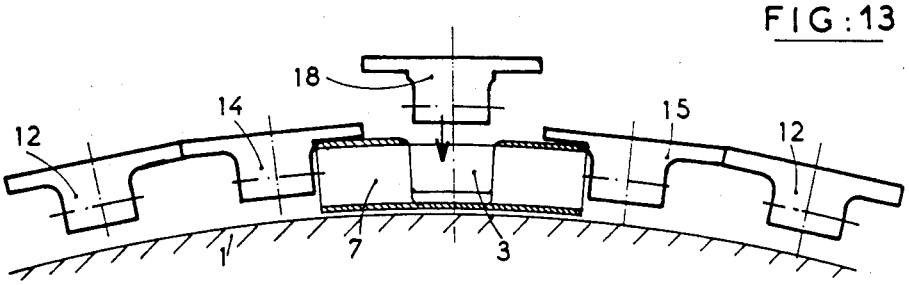
Figure 15:
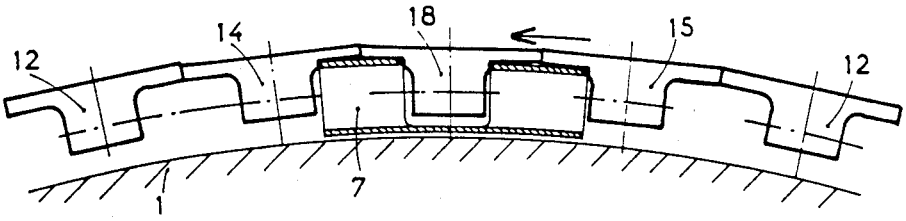

The locking member 7 is also displaced to the left of the "window" ' 3 to enable right lateral sealing blade 15 to be inserted therein, such that a portion of the locking flanges is accommodated by inwardly facing clearance 17 as seen in FIGS. 12 and 13.

The entire row of turbine blades and the locking member 7 are circumferentially displaced such that central clearance 10 of the locking member 7 is in alignment with "window" 3. The central sealing blade 18 is then inserted into the "window" such that the exposed portions of locking flanges 9*a* and 9*b* are accommodated by radially inwardly facing clearances 19 and 20. Following this insertion, the turbine blades and locking member are circumferentially displaced to the left until the locking flanges 9*a* and 9*b* b "snap" into locking notches 4*a*, 5*a*, 4*b* and 5*b*, respectively. These locking notches are circumferentially displaced from the "window" 3 such that, when the turbine blades are locked in position (the locking flanges in engagement with the locking notches) that "window" 3 will not be in alignment with any single foot portion of a turbine blade. The orientation is such that adjacent turbine blade enlarged foot portions will straddle the "window", thereby radially locking all of the turbine blades in position. Since the locking member 7 is located entirely radially inwardly of the annular wall defined by the turbine blade platforms, the platforms form a continuous annular wall without any openings or orifices to cause disturbance of the gas passing over the turbine blades.

Figure 5:
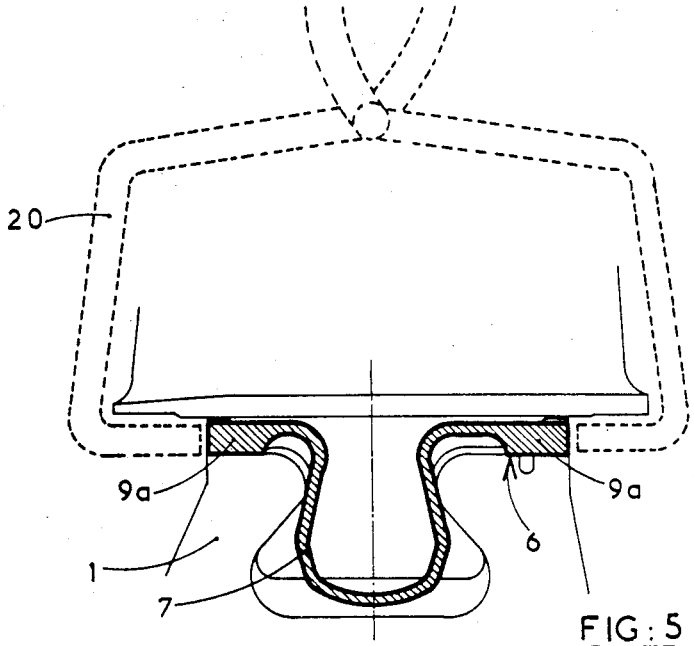
FIG. 5 is a cross-sectional view similar to FIG. 4 showing the turbine wheel rim and the locking member once the locking flanges have engaged the locking notches.
Figure 7:
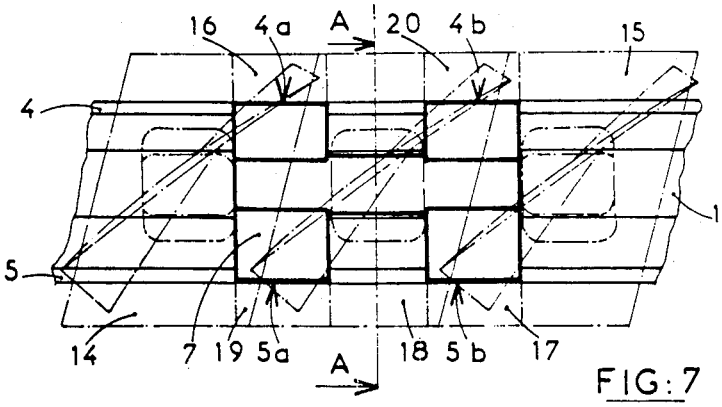
FIG. 7 is a partial, plan view showing the turbine blades locked into place on the turbine wheel.

In order to disassemble the turbine blades and turbine wheel, a compressing tool, such as tongs 20 shown in FIG. 5, is utilized to compress the locking flanges 9*a* and 9*b* axially inwardly of circumferential ribs 4 and 5 to enable the turbine blades and locking member to be circumferentially displaced such that central sealing blade 18 is in alignment with "window" 3. This blade may then be removed and the structure circumferentially displaced such that one of the lateral sealing blades 14 or 15 is in alignment with the "window". Following removal of this blade, the blades and locking member are circumferentially displaced in the opposite direction until the opposite lateral sealing blade is in alignment with the "window". When this blade has been removed, the locking member may be compressed and removed from the circumferential groove 2. Following removal of the locking member 7, the remaining turbine blades are removed by circumferentially displacing them until they are in alignment with the "window" 3.

The foregoing description is provided for illustrative purposes only and should not be construed as in any way limiting this invention, the scope of which is defined solely by the appended claims.

What is claimed is:

1. A system for locking turbine blades having enlarged foot portions and platforms onto a turbine wheel defining a circumferential groove adapted to receive the enlarged foot portions so as to radially retain the blades on the wheel, the wheel further defining a window radially communicating with the circumferential groove to allow radial insertion and withdrawal of the foot portion of a turbine blade, comprising:

(a) first and second circumferentially extending ribs on the turbine wheels, the ribs extending on either side of the circumferential groove and each rib defining locking notches circumferentially spaced from the window; and, (b) a locking device having a resiliently deformable center section adapted to be radially insertable into the circumferential groove and locking flanges extending generally axially from the center section and adapted to contact radially inner portions of platforms of adjacent blades and to engage the locking notches defined by the first and second ribs to circumferentially lock the turbine blads on the wheel such that the foot portions are out of alignment with the window.

2. The turbine blade locking system according to claim 1 wherein each first and second rib defines two circumferentially spaced apart locking notches.

3. The turbine blade locking system according to claim 2 wherein the center section of the locking device has a cross-section similar in shape to the cross-section of the circumferential groove and has two locking flanges extending axially from each side thereof so as to define a central clearance between pairs of locking flanges.

4. The turbine blade locking system according to claim 3 further comprising:

(a) a central sealing blade having a foot portion adapted to be received in the central clearance of the locking device such that at least a portion of the locking flanges are covered by the platform of the central sealing blade; and, (b) a pair of lateral sealing blades having platforms defining radially inwardly facing clearances adapted to accommodate the locking flanges such that, when installed, the locking flanges are covered by the platforms of the central sealing blade and the lateral sealing blades.

5. The turbine blade locking system according to claim 4 wherein the radially inwardly facing clearances of the lateral sealing blades are defined by the platforms on one side of the enlarged foot portion.

6. A method of assembling and circumferentially locking turbine blades having enlarged foot portions and platforms onto a turbine wheel defining a circumferential groove adapted to receive the enlarged foot portions so as to radially retain the blades on the wheel, the wheel further defining a window radially communicating with the circumferential groove and ribs extending circumferentially on both sides of the groove, each rib defining locking notches, comprising the steps of:

(a) inserting the enlarged foot portions of each blade through the window and into the circumferential groove;

(b) displacing each blade circumferentially with the enlarged foot portion in the circumferential groove;

(c) repeating steps (a) and (b) until space for three blades remains on the wheel;

(d) inserting a first lateral sealing blade having a radially inwardly facing first clearance portion formed on its platform and circumferentially displacing the first lateral sealing blade away from the window;

(e) inserting a resiliently deformable locking member into the circumferential groove, the locking member having a center section disposed in the groove, locking flanges extending axially therefrom and defining a central clearance;

(f) circumferentially displacing the locking member until the window is clear and a portion of the locking flanges extend into the first clearance portion;

(g) inserting a second lateral sealing blade having a radially inwardly facing second clearance portion formed on its platform and circumferentially displacing the second lateral sealing blade from the window;

(h) circumferentially displacing the blades and the locking member such that a portion of the locking flanges extend into the second clearance and the central clearance on the locking member is aligned with the window;

(i) inserting a central sealing blade through the window into the central clearance of the locking member such that its platform covers the locking flanges; and, (j) circumferentially displacing the blades and the locking member such that the locking flanges engage the locking notches and the enlarged portions of the blades are out of alignment with the window.

7. The method according to claim 6 comprising the additional step of resiliently deforming the locking member to facilitate insertion of the central portion into the groove such that axialextremities of the locking flanges are located between the circumferential ribs on the wheel.

8. A method of circumferentially unlocking and disassembling a turbine blade and turbine wheel assembly wherein the turbine blades are retained in a circumferential groove formed on the wheel and circumferentially locked in position by a resilient locking member engaging locking notches defined by circumferential ribs on the wheel on both sides of the groove, comprising the steps of:

(a) resiliently deforming the locking member such that it
is disengaged from the locking notches;

(b) circumferentially displacing the blades and the locking
member until a central sealing blade is aligned with the window;

(c) removing the central sealing blade from the wheel;

(d) circumferentially displacing the blades and the locking
member until a first lateral sealing blade is aligned with the window;

(e) removing the first lateral sealing blade from the wheel;

(f) circumferentially displacing the blades and the locking
member until a second lateral sealing blade is aligned with the
window;

(g) removing the second lateral sealing blade from the wheel;

(h) removing the locking member from the wheel; and, (i) circumferentially displacig each of the remaining blades
until it is in alignment with the window and removing it from the
wheel.

* * * * *

UNITED STATES PATENT AND TRADEMARK OFFICE

CERTIFICATE OF CORRECTION

PATENT NO. : 4,818,182

DATED : April 4, 1989

INVENTOR(S) : MICHEL A. BOURU

It is certified that error appears in the above-identified patent and that said Letters Patent is hereby corrected as shown below:

On the title page:

The Assignee should be as follows: "Societe Nationale d'Etude et de Construction de Moteurs d'Aviation".

Col. 2, line 8, "system" should be --systems--.

Col. 2, line 50, "blade" should be --blades--.

Col. 2, line 60, "is extends" should be --it extends--.

Col. 3, line 44, "a enlarged" should be --an enlarged--.

Col. 3, line 54, "rotor disk 1" should be --wheel rim 1--.

Col. 3, line 65, "flat 6" should be --flat portion 6--.

Col. 4, line 49, "FIG. 6" should be --FIG. 6a--.

Col. 5, line 10, "orthogoal" should be --orthogonal--.

Col. 5, line 20, "turing" should be --turning--.

Col. 5, line 63, "9b b'snap'" should be --9b snap--.

Col. 6, claim 1, line 56, "blads" should be --blades--.

Col. 8, claim 7, line 14, "axialextremities" should be --axial extremities--.

Signed and Sealed this

Seventh Day of November, 1989

*Attest:*

JEFFREY M. SAMUELS

*Attesting Officer* *Acting Commissioner of Patents and Trademarks*